US007841665B2

(12) United States Patent
Geister et al.

(10) Patent No.: US 7,841,665 B2
(45) Date of Patent: Nov. 30, 2010

(54) HEIGHT ADJUSTABLE ARMREST

(75) Inventors: Jennifer K. Geister, Alto, MI (US); Adam C. Bedford, Rockford, MI (US); Jonathan B. Hadley, Federal Way, WA (US)

(73) Assignee: Steelcase Inc., Grand Rapids, MI (US)

( * ) Notice: Subject to any disclaimer, the term of this patent is extended or adjusted under 35 U.S.C. 154(b) by 496 days.

(21) Appl. No.: 11/757,187

(22) Filed: Jun. 1, 2007

(65) Prior Publication Data

US 2008/0296955 A1 Dec. 4, 2008

(51) Int. Cl.
*A47C 7/54* (2006.01)

(52) U.S. Cl. ..... 297/411.36

(58) Field of Classification Search ..... 297/338, 297/353, 411.36

See application file for complete search history.

(56) References Cited

U.S. PATENT DOCUMENTS

| | | | | |
|---|---|---|---|---|
| 2,913,208 | A | 11/1959 | McKinley | |
| 3,201,079 | A | 8/1965 | Doetsch | |
| 3,289,995 | A | 12/1966 | Taylor | |
| 3,560,033 | A | 2/1971 | Barkus | |
| 3,617,023 | A | 11/1971 | Schneiderman | |
| 3,705,704 | A | 12/1972 | Textoris | |
| 4,084,776 | A | 4/1978 | Cook | |
| 4,262,871 | A | 4/1981 | Kolk et al. | |
| 4,365,839 | A | 12/1982 | Strassle | |
| 4,412,667 | A | 11/1983 | Doerner | |
| 4,534,533 | A | 8/1985 | Doerner | |
| 4,616,877 | A * | 10/1986 | Slaats et al. | 297/353 |
| 4,744,538 | A | 5/1988 | Hofman | |
| 4,911,391 | A | 3/1990 | Ellis | |
| 4,998,699 | A | 3/1991 | Butler | |
| 5,149,035 | A | 9/1992 | Bonnema et al. | |
| 5,393,125 | A | 2/1995 | Watson et al. | |
| 5,402,973 | A | 4/1995 | Haines | |
| 5,439,267 | A | 8/1995 | Peterson et al. | |
| 5,590,934 | A | 1/1997 | Gibbs | |
| 5,599,067 | A | 2/1997 | Schuelke et al. | |
| 5,620,233 | A | 4/1997 | Corwin | |
| 5,692,715 | A | 12/1997 | Hertel | |

(Continued)

FOREIGN PATENT DOCUMENTS

| | | | |
|---|---|---|---|
| JP | 2001-186960 | A | 7/2001 |

(Continued)

*Primary Examiner*—Joseph F Edell
(74) *Attorney, Agent, or Firm*—Price, Heneveld, Cooper, DeWitt & Litton, LLP

(57) ABSTRACT

A vertically adjustable armrest includes a tubular support constructed for attachment to a chair, an armrest assembly telescopingly positioned in the tubular support, the armrest assembly including a sleeve and a post, the sleeve including an opening adapted to receive an operative member on one side, and the post including positional detents extending down the length of a first vertical surface. The height adjustment mechanism is slidably received in the armrest assembly and includes an actuator rod having an angled ramp, an inclined surface, and a pair of angled surfaces, a locking member having teeth which are biased to selectively mate with the post detents, an inclined surface, and at least one pair of lateral followers. The actuator rod operatively engages the locking member with the inclined wedge mateably engaged with the inclined surface and the angled surfaces slideably engaged with the lateral followers.

18 Claims, 6 Drawing Sheets

U.S. PATENT DOCUMENTS 5,848,823 A 12/1998 Su
5,895,095 A 4/1999 Chen
5,906,343 A 5/1999 Battey et al.
5,931,536 A 8/1999 Wu
5,938,156 A 8/1999 Kao
5,964,436 A 10/1999 Battey et al.
5,971,484 A 10/1999 Lamart et al.
6,053,579 A 4/2000 Nelson et al.
D436,259 S 1/2001 Nagamitsu
D442,790 S 5/2001 Simons, Jr. et al.
D442,791 S 5/2001 Simons, Jr. et al.
6,290,191 B1 9/2001 Hendricks et al.
6,367,877 B1 4/2002 Knoblock et al.
6,394,553 B1 * 5/2002 McAllister et al. ..... 297/411.36
6,398,309 B1 6/2002 Chen
6,419,323 B1 7/2002 Chu et al.
D461,323 S 8/2002 Su
D462,188 S 9/2002 Su
6,460,928 B2 10/2002 Knoblock et al.
6,460,932 B1 10/2002 Kopish et al.
6,523,895 B1 2/2003 Vogtherr
D479,656 S 9/2003 Ma
6,619,746 B2 9/2003 Roslund, Jr. et al.
6,626,404 B2 9/2003 Kleinikel et al.
6,637,072 B2 10/2003 Footitt et al.
6,669,292 B2 12/2003 Koepke et al.
D486,657 S 2/2004 Su
6,704,990 B2 3/2004 Kleinikel et al.
D489,191 S 5/2004 Ma
D489,541 S 5/2004 Su
D493,627 S 8/2004 Ma
D494,768 S 8/2004 Su
D509,969 S 9/2005 Loew et al.
6,948,775 B2 9/2005 Tsai
6,957,866 B1 10/2005 Cai
D511,418 S 11/2005 Breen
D512,232 S 12/2005 Wu
6,974,189 B2 12/2005 Machael et al.
6,974,190 B1 12/2005 Hung
D517,335 S 3/2006 Kinoshita et al.
D520,254 S 5/2006 Kinoshita
D520,764 S 5/2006 Kinoshita et al.
D521,755 S 5/2006 Kinoshita et al.
7,040,709 B2 5/2006 Knoblock et al.
7,448,687 B2 * 11/2008 Tsai ..... 297/411.36
7,533,939 B2 * 5/2009 Fookes et al. ..... 297/411.36
2003/0214171 A1 11/2003 Burwell et al.
2004/0227388 A1 11/2004 Wang
2005/0146192 A1 7/2005 Trego et al.

FOREIGN PATENT DOCUMENTS

KR 10-2005-0037280 4/2005
WO WO 96-39902 A1 12/1996

* cited by examiner

HEIGHT ADJUSTABLE ARMREST

CROSS-REFERENCE TO RELATED APPLICATIONS

This application is related to co-assigned application Ser. No. 11/757,169 filed Jun. 1, 2007, now U.S. Pat. No. 7,604, 298 which issued on Oct. 20, 2009 (on even date herewith), entitled CHAIR BACK ATTACHMENT AND METHOD OF ASSEMBLY, and also related to co-assigned application Ser. No. 11/757,138 filed Jun. 1, 2007 (on even date herewith), entitled SEATING UNIT WITH ADJUSTABLE LUMBAR DEVICE, the entire contents of both of which are incorporated herein by reference.

BACKGROUND OF THE INVENTION

The present invention relates to a vertically adjustable arm assembly for a chair.

Adjustable armrests allow users to comfortably support their forearms while working. This can be particularly important to people working in an office environment where they may stay seated for long periods of time. In an attempt to adapt a chair armrest to a particular user and to a task involved, various adjustment mechanisms have been provided. However, in an effort to make highly adjustable armrests more comfortable and secure, complicated latching and securing mechanisms are added. Unfortunately, more complicated mechanisms can be difficult for a user to operate. Also, multi-part mechanisms cart lead to quality problems during manufacture, warranty problems in service, and additional manufacturing expense.

A need exists for a chair and an armrest assembly which is adapted for vertical height adjustment, which is relatively easily manufactured, which is reliable In operation and which provides a wide variety of adjustable positions for the user.

SUMMARY OF THE INVENTION

In one aspect of the present invention, an armrest construction for chairs includes a tubular support constructed for attachment to a chair, an armrest assembly telescopingly positioned in the tubular support, and a height adjustment mechanism slidably received in the armrest assembly. The armrest assembly includes a sleeve and a post. The sleeve includes an opening adapted to receive an operative member on one side. The post includes detents extending down the length of a first vertical surface. The height adjustment mechanism includes an actuator rod, an operative member, a locking member, and a resilient member. The actuator rod includes an angled ramp, an inclined surface, and a pair of angled surfaces, and the locking member includes teeth, an inclined surface, and a pair of lateral followers. The actuator rod operatively engages the locking member with the inclined wedge mateably engaged with the inclined surface and the angled surfaces slideably engaged with the lateral followers.

In another aspect of the present invention, an armrest construction for chairs includes a tubular support having a first arm constructed for attachment to a chair and a second arm which extends upward from the first arm and further includes a groove. The armrest also includes an armrest assembly telescopingly positioned in the tubular support, where the armrest, assembly includes a sleeve and a post. The sleeve includes an opening adapted for receiving an operative member on a first side of the sleeve and an aperture on a second side of the sleeve. The post includes detents extending down the length of a first vertical surface which covers the aperture on the second side of the sleeve. The armrest also includes a height adjustment mechanism which is slidably received in the armrest, assembly, the height adjustment mechanism including an actuator rod, an operative member, a locking member, and a resilient member. The actuator rod includes an angled ramp, an inclined surface, and a pair of angled surfaces. The locking member includes teeth which selectively mateably engage the post detents, an inclined surface, and at least one pair of lateral followers. The actuator rod operatively engages the locking member with the inclined wedge mateably engaged with the inclined surface and the angled surfaces slideably engaged with the lateral followers.

In another aspect of the present invention, a method of vertically adjusting an armrest includes providing an armrest which includes a tubular support including a groove which is constructed for attachment to a chair, an armrest assembly telescopingly positioned in the tubular support, and a height adjustment mechanism slidably received in the armrest assembly. The armrest assembly includes a sleeve having an opening adapted for receiving an operative member, an aperture and a post. The post includes detents extending down the length of a first vertical surface. The height adjustment mechanism includes an actuator rod including an angled ramp, an inclined wedge, and a pair of angled surfaces. The height adjustment mechanism also includes a resilient member, an operative member, and a locking member including teeth, an inclined surface, and two pairs of lateral followers. The teeth of the locking member extend through the aperture and selectively mate with the detents. The actuator rod is positioned over the locking member with the inclined wedge mateably engaged with the inclined surface and the angled surfaces mateably engaged with the lateral followers. The operative member is lifted upward such that the resilient member compresses, which causes the angled surfaces to push on the lateral followers and the teeth to withdraw the locking member from locking engagement with the detents. The armrest can then be adjusted to a desired position. Releasing the operative member such that the resilient member decompresses causes the inclined wedge to slide into mateable engagement with the inclined surface and the teeth to extend through the aperture and mate with the detents.

These and other features, advantages, and objects of the present invention will be further understood and appreciated by (hose skilled in the art by reference to the following specification, claims, and appended drawings.

BRIEF DESCRIPTION OF THE DRAWINGS

FIG. 11A is an enlarged fragmentary view of the circled area XIA in FIG. 11;

DETAILED DESCRIPTION OF PREFERRED EMBODIMENT

Figure 1:
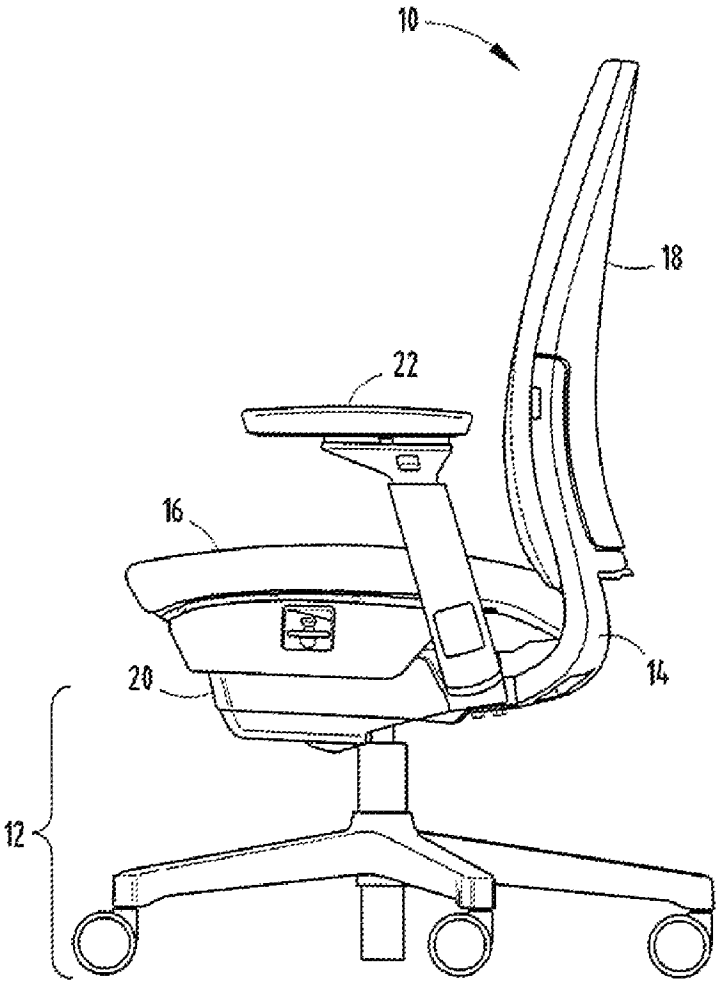
FIG. 1 is a left side elevational view of a chair embodying the present invention.

Referring to FIG. 1, a chair 10 embodying the present invention includes a base 12, a lower back frame 14, a seat 16 and a back construction 18. The base 12 includes a control housing 20 with a fixed side support structure which extends laterally and upwardly from either side of the control housing. An armrest 22 is attached to each side of the support structure.

Figure 2:
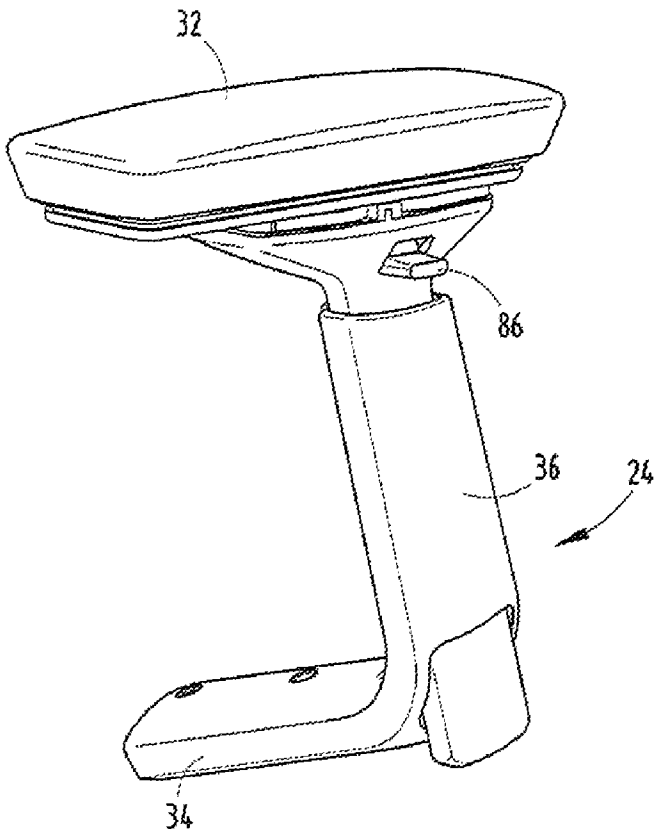
FIG. 2 is a left side perspective view of an armrest, of the chair of FIG. 1.
Figure 3:
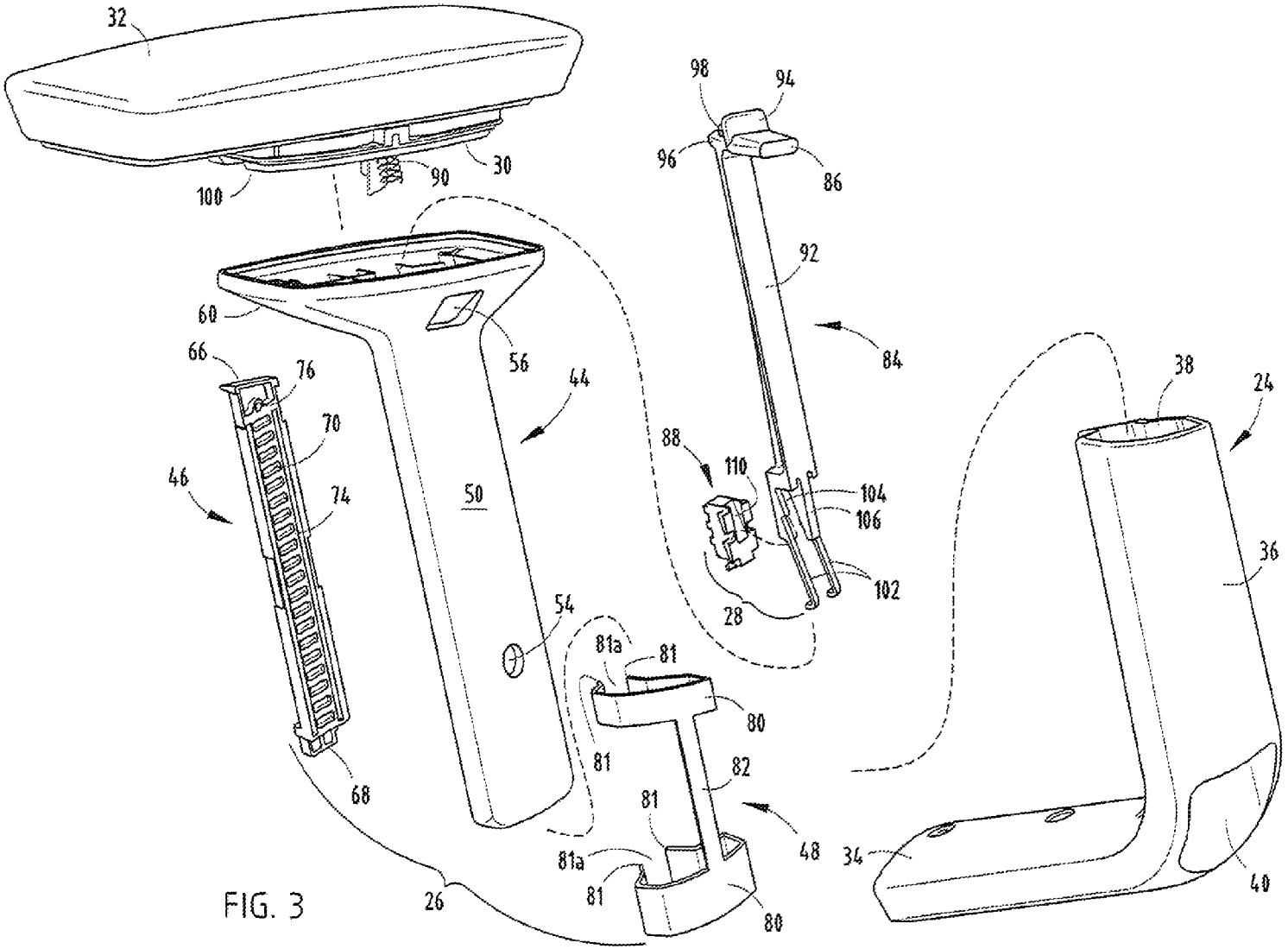
FIG. 3 is an exploded view of the armrest in FIG. 2.
Figure 4:
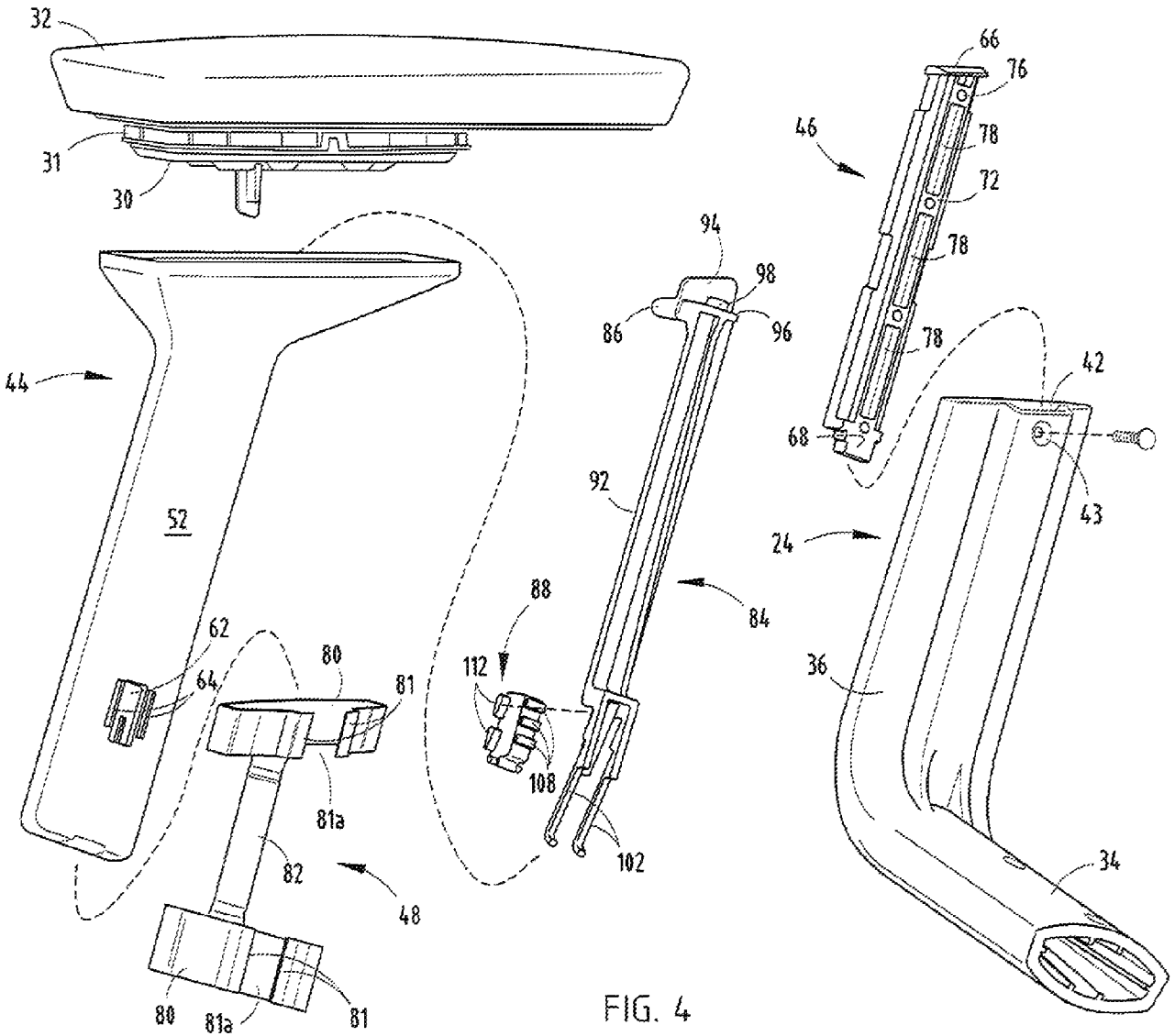
FIG. 4 is an exploded left side perspective view of an armrest embodying the present invention.

An armrest 22 embodying the present invention is shown, in FIGS. 2-4 and includes a tubular support 24 constructed for attachment, to a chair 10, an armrest assembly 26 telescopingly positioned in the tubular support, and a height adjustment mechanism 28 slidably received in the armrest assembly. A plate 30 is attached to the top of the armrest assembly 26 and an arm cap 32 is attached to the plate. In an alternative embodiment, a pivot/slide member 31 may be attached to the plate and the arm cap 32 attached to the pivot/slide member. The pivot/slide member is similar to that disclosed in co-assigned U.S. Pat. No. 5,971,484, filed Dec. 3, 1997, entitled "ADJUSTABLE ARMREST FOR CHAIRS," the contents of which are incorporated herein by reference, for its teachings.

Referring to FIGS. 3 and 4, the tubular support 24 includes an L-shaped structural member having a horizontal first arm section 34 adapted for connection to the fixed side support structures, and a vertically extending second arm section 36. The second arm section 36 includes an upper opening 38 for telescopingly receiving the armrest assembly 26, a lower opening 40, and a groove 42 including a fastening aperture 43, along one vertical side. When the armrest assembly 26 is inserted into the second arm section 36, the lower portion of a sleeve 44 extends through the lower opening 40 and is visible. As the armrest assembly is vertically adjusted upward, the sleeve becomes less visible. The groove 42 and the lower opening 40 are on opposite sides of the second arm section 36.

Figures 5, 6, 7, 8, 9:
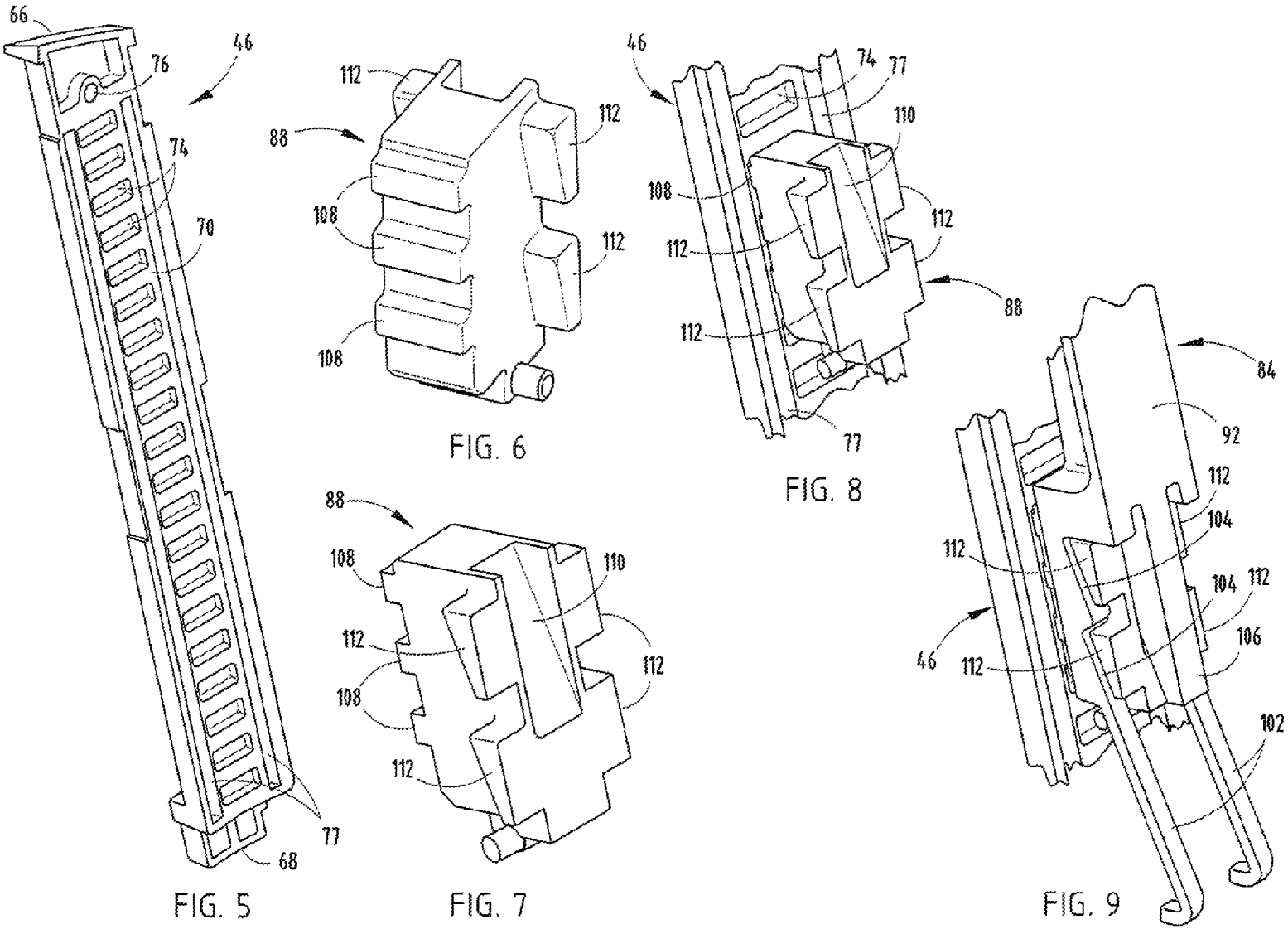
FIG. 5 is a perspective view of a post showing a first vertical surface of tire post including detents.
FIG. 6 is a front perspective view of a locking member.
FIG. 7 is a rear perspective view of the locking member of FIG. 6.
FIG. 8 is a fragmentary view of the post and locking member.
FIG. 9 is a fragmentary view of the post, locking member and actuator rod.

The armrest assembly 26 is telescopingly received in the tubular support 24 and includes a sleeve 44, a post 46, and may also include a bearing 48. The sleeve 44 includes a first side 50 and a second side 52. The first side 50 includes an aperture. 54 near the lower end of the first side. Near the top of the first side 50 is an opening 56 which is adapted to receive an operative member 86 of an actuator rod 84. The sleeve 44 flares out at the top to provide an armrest support 60. The second side 52 of the sleeve 44 includes a rectangular aperture 62 at the lower end of the second side. On either side of the aperture 62 are vertical ribs 64. Referring to FIGS. 3-5, the post is rectangular with a lip 66 on its top end and a tab 68 on the bottom end. The post also includes a first vertical surface 70 and a second vertical surface 72. The first vertical surface 70 includes a series of positional detents 74 and a fastening aperture 76 (FIG. 5). The fastening aperture 76 goes completely through the post 46 to the second vertical surface 72. On either side of the positional detents 74 are vertical grooves 77 which mateably receive the vertical ribs 64 on the sleeve 44 to prevent complete removal of the armrest assembly 26 from the tubular support 24. The second vertical surface 72 includes ridges 78. The bearing 48 provides a bearing surface and includes two collars 80 which are connected to a vertical strip 82 at their midpoints. Although FIGS. 3 and 4 show the collars 80 as angled relative to each other, in an alternative embodiment, the collars are parallel relative to each other. The ends 81 of the collars 80 dare outwardly to define a space 81*a*.

The post 46 is mateably received in the groove 42 of the second arm section 36, with the second vertical surface 72 abutting the second arm section. A fastening means is inserted through fastening aperture 43 and into fastening aperture 76 to secure the post 46 in the groove 42. Alternatively, it is contemplated that the post 46 is not a separate piece fastened in the groove 42, but rather molded into the second arm section 36. When the sleeve 44 is inserted into the second arm section 36, the first vertical surface 70 of the post 46 abuts the second side 52 of the sleeve. Also, the detents 74 on the first vertical surface 70 of the post 46 cover the aperture 62 on the second side 52 of the sleeve 44. The vertical ribs 64 on the second side 52 of the sleeve 44 mate with the vertical grooves 77 of the post 46 so that the positional detents 74 remain positioned over the aperture 62 when the sleeve is adjusted vertically. The bearing 48 is positioned on the sleeve 44 with the vertical strip 82 abutting the first side 50 of the sleeve 44, allowing the collars 80 to wrap around the sleeve. The post 46 fits between the collar ends 81 in the space 81*a*. The bearing 48 is stationary within the second arm section 36 and functions to limit horizontal movement of the sleeve within the tubular support.

As shown in FIGS. 3 and 4, the height adjustable mechanism 28 includes an actuator rod 84, including an operative member 86, a locking member 88, and a spring 90. At the top of the actuator rod 84, is an operative member 86 which is generally perpendicular to an elongated portion 92 of the actuator rod 84. As shown, the operative member 86 is a lever, however, it is contemplated that a button or tab could be used. Attached to the operative member 86 is a flange 94. On the other side of the flange 94 is a ledge 96 having a protrusion 98. When the height adjustable mechanism 28 is slidably engaged with the armrest assembly 26, the actuator rod 84 is positioned inside the sleeve 44 with the operative member 86 positioned through aperture 56. One end of the spring 90 is placed over the protrusion 98, with the opposite end of the spring 90 placed over a protrusion 100 on the underside of the plate 30. Referring to FIGS. 3, 4 and 9, at the bottom of the actuator rod 84 are two angled ramps 102 which resemble hooks. The angled ramps 102 prevent the locking member 88 from falling to the bottom of the sleeve 44. Above each angled ramp 102 is at least one angled surface, and preferably a pair of angled surfaces 104. Between the pair of angled surfaces 104 is an inclined wedge 106.

As best seen in FIGS. 6-8, the locking member 88 includes teeth 108 that selectively mateably engage the detents 74 on the post 46. The locking member 88 also includes an inclined surface 110 that mates with the inclined wedge 106. The locking member 88 also includes at least one pair, and preferably two pairs of lateral followers 112 which releasably mateably engage the two pairs of angled surfaces 104.

Figure 10A:
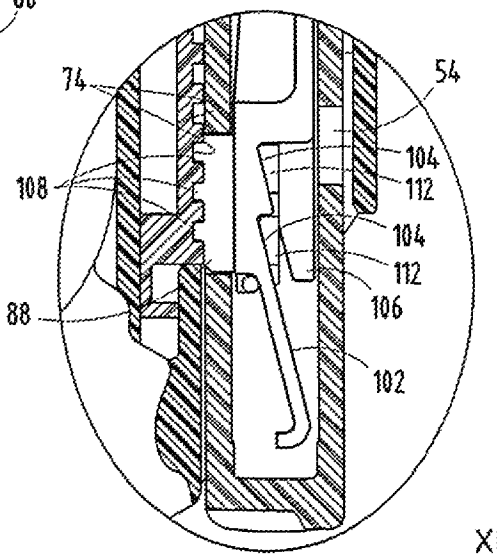
FIG. 10 is a cross-sectional view of the armrest embodying the present invention showing the armrest in a locked position.
Figure 10:
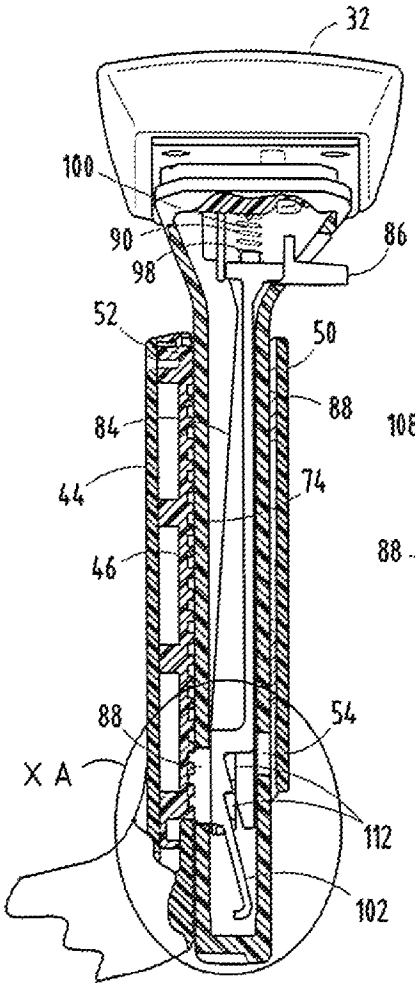
Figure 13A:
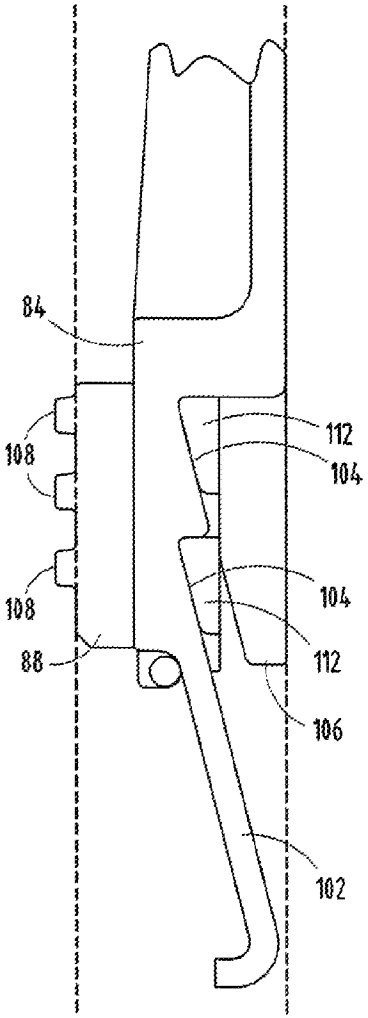
FIG. 13A is an enlarged schematic view of the circled area XIIIA in FIG. 13.
Figure 13:
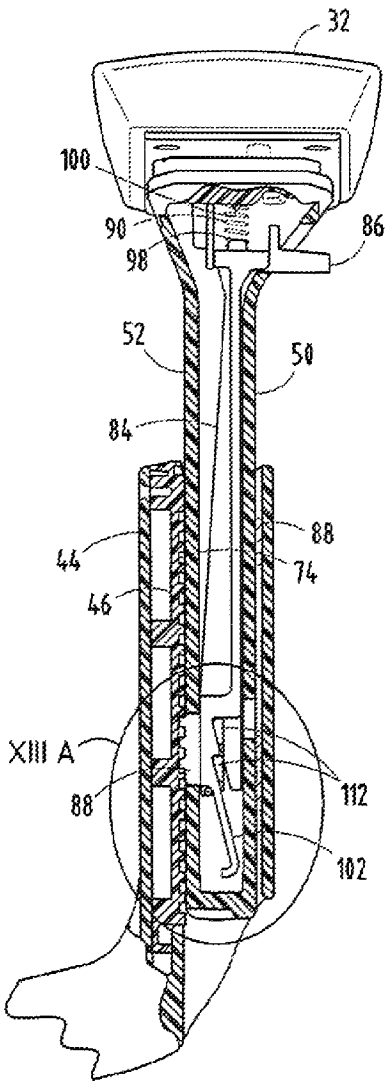
FIG. 13 is a cross-sectional view of the armrest in FIG. 10 shown in a locked position.
Figure 12A:
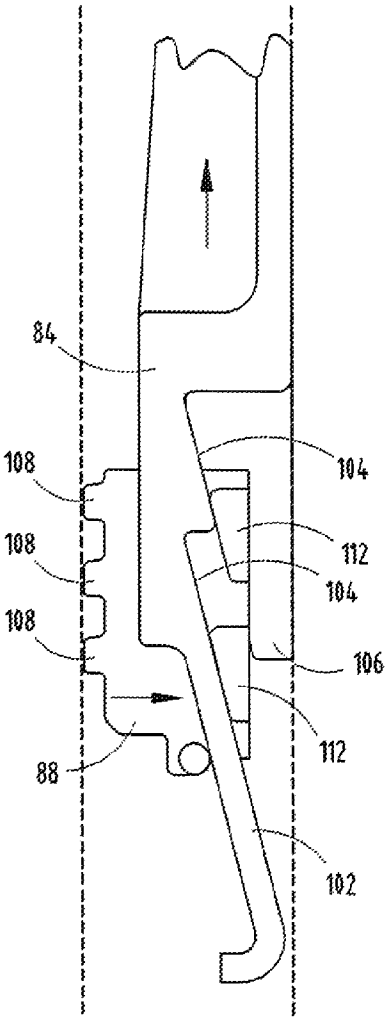
FIG. 12A is an enlarged schematic view of the circled area XIIA in FIG. 12.
Figure 12:
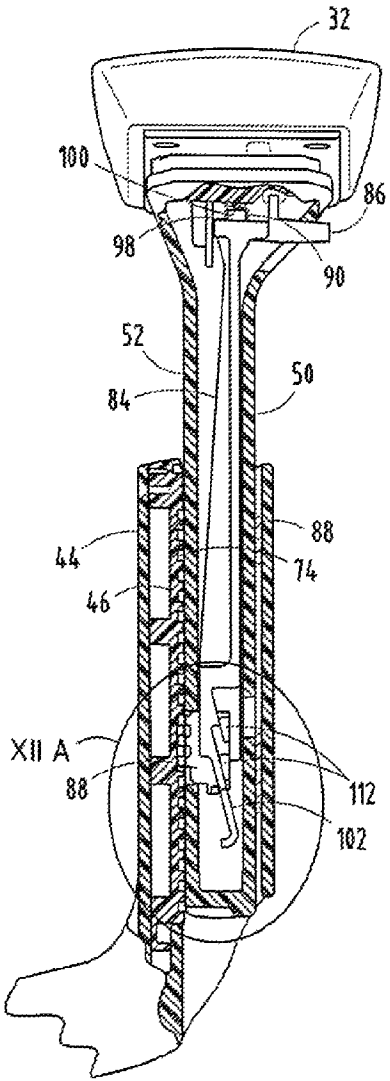
FIG. 12 is a cross-sectional view of the armrest in FIG. 10 shown in an unlocked position.

The height adjustable mechanism 28 is slidably engaged within the sleeve 44. When in a locked position, the locking member 88 of the height adjustable mechanism 28 is positioned such that the teeth 108 of the locking member extend through aperture 62 of the sleeve 44 and selectively mate with the detents 74 of the post 46. The actuator rod 84 is positioned over the locking member 88 with the inclined wedge 106 mateably engaged with the inclined surface 110 and the angled surfaces 104 releasably mateably engaged with the lateral followers 112. (FIGS. 9, 10 and 10A).

Figure 11A:
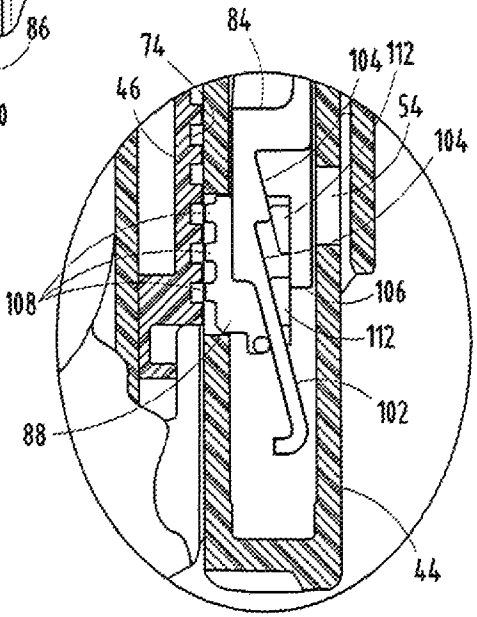
FIG. 11A is an enlarged fragmentary view of the circled area XA in FIG. 10.
Figure 11:
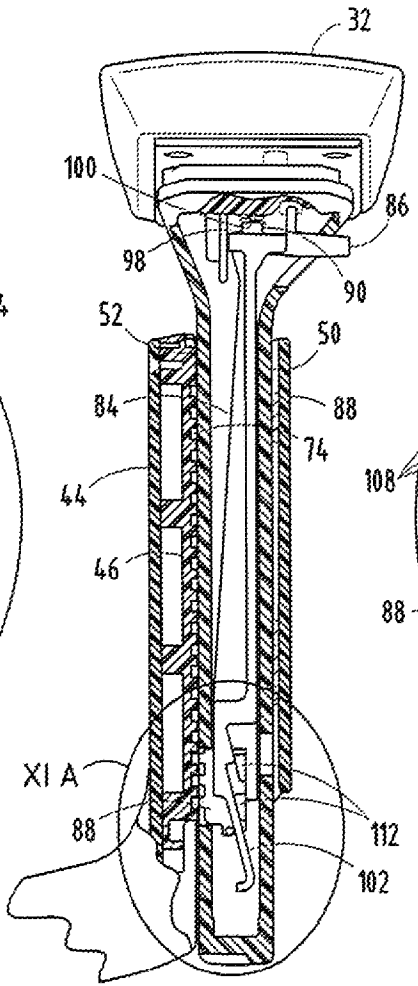
FIG. 11 is a cross-sectional view of the armrest In FIG. 10 shown in an unlocked position.

To vertically adjust the height of the armrest, the operative member 86 is lifted upward, which in turn, compresses the spring 90. When the spring compresses, the angled surfaces 104 of the actuator rod 84 lift upward and push on the lateral followers 112, which causes the teeth 108 to withdraw into the sleeve 44, thereby removing the locking member 88 from locking engagement with the detents 74 (FIGS. 11 and 11A). Once the locking member 88 is disengaged from the detents 74, the armrest can be vertically adjusted upward or downward to a desired height.

To reengage the locking member 88 and relock the armrest in a selected position, the operative member 86 is released, thereby decompressing the spring 90 at the top of the actuator rod 84. Decompression of the spring causes the inclined wedge 106 to slide into mateable engagement with the inclined surface 110. (FIGS. 12, 12A, 13 and 13A). As the inclined wedge 106 and inclined surface 110 are mateably engaged, the teeth 108 of the locking member again extend through the aperture 62 and selectively mate with the detents 74 of the post 46.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. An armrest comprising:

a tubular support constructed for attachment to a chair;

an armrest assembly telescopingly positioned in the tubular support, wherein the armrest assembly comprises a sleeve and a post; wherein the sleeve includes an aperture adapted to receive an operative member of a height adjustment mechanism; wherein the post includes detents extending down the length of a first vertical surface; and the height adjustment mechanism slidably received in the armrest assembly, wherein the height adjustment mechanism comprises an actuator rod including an angled ramp, an inclined wedge, and a pair of angled surfaces, wherein the inclined wedge and the angled surfaces are substantially parallel with one another; the operative member; a locking member including teeth, an inclined surface, and a pair of lateral followers; and a resilient member; and wherein the actuator rod operatively engages the locking member with the inclined wedge mateably engaged with the inclined surface and the angled surfaces slideably engaged with the lateral followers.

2. The armrest according to claim 1 further comprising a plate attached to the armrest assembly and an arm cap attached to the plate.

3. The armrest according to claim 1, further comprising a plate attached to the armrest assembly, a pivot/slide member attached to the plate, and an arm cap attached to the pivot/slide member.

4. The armrest according to claim 1, wherein the armrest assembly further comprises a bearing.

5. The armrest according to claim 4, wherein the bearing comprises two collars which are connected at their midpoints to a vertical strip, and wherein the resilient member comprises a spring.

6. The armrest according to claim 1, wherein the post further comprises a ridge extending down the length of a second vertical surface of the post.

7. The armrest according to claim 1, wherein the tubular support comprises a first arm for attachment to a chair and a second arm extending upwardly from the first arm, wherein the second arm includes a groove for mateably engaging the post.

8. The armrest according to claim 7, wherein the sleeve further includes an aperture which when positioned in the tubular support is covered by the post.

9. The armrest according to claim 8, wherein the sleeve further comprises vertical ribs on either side of the aperture, wherein the post further comprises vertical grooves on either side of the detents; and wherein the vertical grooves mateably engage the vertical ribs.

10. The armrest according to claim 1, wherein the locking member further comprises a second pair of lateral followers.

11. An armrest comprising:

a tubular support comprising a first arm constructed for attachment to a chair and a second arm extending upwardly from the first arm, the second arm further comprising a groove;

an armrest assembly telescopingly positioned in the tubular support, wherein the armrest assembly comprises a sleeve and a post; wherein the sleeve includes an opening on a first side of the sleeve adapted for receiving an operative member and an aperture on a second side of the sleeve; wherein the post covers the aperture of the sleeve and includes detents extending down the length of a first vertical surface; and a height adjustment mechanism slidably received in the armrest assembly, wherein the height adjustment mechanism comprises an actuator rod including an angled ramp, an inclined wedge, and a pair of angled surfaces, wherein the inclined wedge and the angled surfaces are substantially parallel with one another; the operative member; a locking member including teeth which selectively mateably engage the post detents, an inclined surface, and at least one pair of lateral followers; and a resilient member; and wherein the actuator rod operatively engages the locking member with the inclined wedge mateably engaged with the inclined surface and the angled surfaces slideably engaged with the lateral followers.

12. The armrest according to claim 11 further comprising a plate attached to the armrest assembly and an arm cap attached to the plate.

13. The armrest according to claim 12 wherein the actuator rod further comprises a ledge having a protrusion and the plate further comprises a tab on the bottom of the plate; and wherein the resilient member is disposed between the actuator rod and the plate and is connected to the protrusion and the tab.

14. The armrest according to claim 11, further comprising a plate attached to the armrest assembly, a pivot/slide member attached to the plate, and an arm cap attached to the pivot/slide member.

15. The armrest according to claim 11, wherein the armrest assembly further comprises a bearing.

16. The armrest according to claim 15, wherein the operative member comprises a lever, the resilient member comprises a spring, and the bearing comprises two collars which are connected at their midpoints to a vertical strip.

17. The armrest according to claim 11, wherein the post further comprises a ridge extending down the length of a second vertical surface.

18. An armrest comprising:

a tubular support constructed for attachment to a chair;

an armrest assembly telescopingly positioned in the tubular support, wherein the armrest assembly comprises a sleeve and a post; wherein the sleeve includes an aperture adapted to receive an operative member of a height adjustment mechanism; wherein the post includes detents extending down the length of a first vertical surface; and the height adjustment mechanism slidably received in the armrest assembly, wherein the height adjustment mechanism comprises an integral, single-piece actuator rod including an angled ramp, an inclined wedge, and a pair of angled surfaces; the operative member; a locking member including teeth, an inclined surface, and a pair of lateral followers; and a resilient member; and wherein the actuator rod operatively engages the locking member with the inclined wedge mateably engaged with the inclined surface and the angled surfaces slidably engaged with the lateral followers.

* * * * *